US008857085B1

(12) United States Patent
Lewis

(10) Patent No.: US 8,857,085 B1
(45) Date of Patent: Oct. 14, 2014

(54) VEHICLE IDENTIFICATION CARD

(71) Applicant: Mark W. Lewis, Greenville, SC (US)

(72) Inventor: Mark W. Lewis, Greenville, SC (US)

( * ) Notice: Subject to any disclaimer, the term of this patent is extended or adjusted under 35 U.S.C. 154(b) by 0 days.

(21) Appl. No.: 14/132,726

(22) Filed: Dec. 18, 2013

Related U.S. Application Data

(60) Provisional application No. 61/745,069, filed on Dec. 21, 2012.

(51) Int. Cl.
*B65D 27/00* (2006.01)
*G09F 7/00* (2006.01)

(52) U.S. Cl.
CPC ..... *G09F 7/00* (2013.01)
USPC ..... 40/630; 40/673; 40/634; 40/594; 40/593

(58) Field of Classification Search
CPC ..... G09F 3/00; G09F 3/10; G09F 3/203; G09F 3/0288; A44B 15/002
USPC ..... 40/634, 673, 664, 665, 360, 593, 594
See application file for complete search history.

(56) References Cited

U.S. PATENT DOCUMENTS

| | | | | |
|---|---|---|---|---|
| 2,578,548 | A | 12/1951 | Histed | |
| 3,757,936 | A * | 9/1973 | Lindegren | 206/527 |
| 4,846,501 | A | 7/1989 | Del Grande | |
| 4,907,359 | A | 3/1990 | Berman | |
| 5,104,148 | A | 4/1992 | Neal | |
| 5,560,657 | A | 10/1996 | Morgan | |
| 5,782,497 | A | 7/1998 | Casagrande | |
| 6,250,556 | B1 * | 6/2001 | Schneider | 235/487 |
| 6,352,287 | B2 | 3/2002 | Casagrande | |
| 6,352,608 | B1 | 3/2002 | Garden | |
| 6,649,238 | B2 | 11/2003 | Chess et al. | |
| 7,246,459 | B2 | 7/2007 | Lewis | |
| 7,249,432 | B2 * | 7/2007 | Lewis | 40/673 |
| 7,316,088 | B1 | 1/2008 | Lewis | |
| 7,373,749 | B1 | 5/2008 | Lewis | |
| 7,950,172 | B1 * | 5/2011 | Lewis | 40/360 |
| 2003/0106250 | A1 | 6/2003 | Best et al. | |
| 2004/0026916 | A1 | 2/2004 | Thompson et al. | |
| 2005/0236832 | A1 | 10/2005 | Best et al. | |
| 2006/0163868 | A1 | 7/2006 | Baumann | |
| 2006/0236578 | A1 | 10/2006 | Saint et al. | |

* cited by examiner

*Primary Examiner* — Casandra Davis
(74) *Attorney, Agent, or Firm* — Amy Allen Hinson; Nexsen Pruet, LLC

(57) ABSTRACT

A vehicle identification card having a multi-segmental sheet is disclosed. The sheet includes a first, second, and third segment having the same vehicle identification number thereon. The first segment has a front and back side. The back side of the first segment includes a layer of adhesive material and a removable liner covering the adhesive. The second segment has a removable key tag and a vehicle identification claim ticket. The key tag has an elongated tail with a first slit extending along a longitudinal dimension of the tail and a body for inclusion of vehicle identification information. The third segment is positioned between the first segment and the second segment and includes an upper portion and a lower portion with an opening therebetween. The upper portion and the lower portion are joined by a securing strip.

20 Claims, 3 Drawing Sheets

VEHICLE IDENTIFICATION CARD

CROSS-REFERENCE TO RELATED APPLICATIONS

This application claims priority to U.S. Provisional Patent Application No. 61/745,069 filed Dec. 21, 2012 which is incorporated herein by reference.

BACKGROUND

The present invention discloses a vehicle identification card particularly suitable for use in connection with the vehicle parking and servicing industry.

Businesses concerned with parking or servicing vehicles frequently have issues correlating and identifying a particular vehicle, the ignition key for that vehicle, and the owner of that vehicle. A significant amount of wasted time sorting through keys typically results if business personnel fail to properly correlate keys with a particular vehicle immediately when a vehicle owner gives the keys to business personnel. Furthermore, if business personnel give the wrong keys to someone who is not the proper owner of a particular vehicle, damage to reputation as well as theft may occur.

Thus there is a need in the art for an effective, efficient, and inexpensive device for correlating and identifying a particular vehicle and the ignition key and owner for that vehicle.

SUMMARY

The present invention provides a vehicle identification card. In one embodiment of the present invention, the vehicle identification card includes a multi-segmental sheet having a first segment with a front and back side. The back side of the first segment includes a layer of adhesive material and a removable liner covering the adhesive. The sheet also includes a second segment having a removable key tag and a vehicle identification claim ticket. The key tag includes an elongated tail with a slit extending along a longitudinal dimension of the tail and a body for inclusion of vehicle identification information. Further, the sheet includes a third segment positioned between the first segment and the second segment. The third segment includes an upper portion and a lower portion with an opening therebetween. The upper portion and the lower portion are joined by a securing strip. The first, second, and third segments have the same vehicle identification number thereon.

In an alternative embodiment of the present invention, the vehicle identification card includes a multi-segmental sheet having a first, second, and third segment. The first segment includes a front and back side wherein the back side of the first segment includes a layer of adhesive material and a removable liner covering the adhesive. The liner includes a longitudinally extending first slit to assist with removal of the liner. The second segment includes a removable key tag and a vehicle identification claim ticket. The key tag has an elongated tail with a second slit extending along a longitudinal dimension of the tail and a body for inclusion of vehicle identification information. The body includes a perforated opening and the body is insertable through the second slit. The third segment is positioned between the first segment and the second segment and includes an upper portion and a lower portion with an opening therebetween. The upper portion and the lower portion are joined by a removable securing strip. The first, second, and third segments have the same vehicle identification number thereon. Further, the first segment is separable from the third segment by perforations extending between the first and third segments. The second segment is separable from the third segment by perforations extending between the second and third segments.

DESCRIPTION OF REPRESENTATIVE EMBODIMENTS

The present invention discloses a vehicle identification card device particularly suitable for use in connection with the vehicle parking and servicing industry. The unique design and features of the vehicle identification card device preferably allows for effective, efficient, and inexpensive correlation and identification of a particular vehicle and the ignition key and owner for that vehicle. Although primarily described herein in terms of its use in connection with the vehicle parking and servicing industry, it will be clear that the identification card device of the present invention may also be used in connection with a variety of other uses and industries. The invention will be described with reference to the figures forming an integral non-limiting part of the instant specification. Throughout the description, similar elements will be numbered accordingly.

Figure 1:
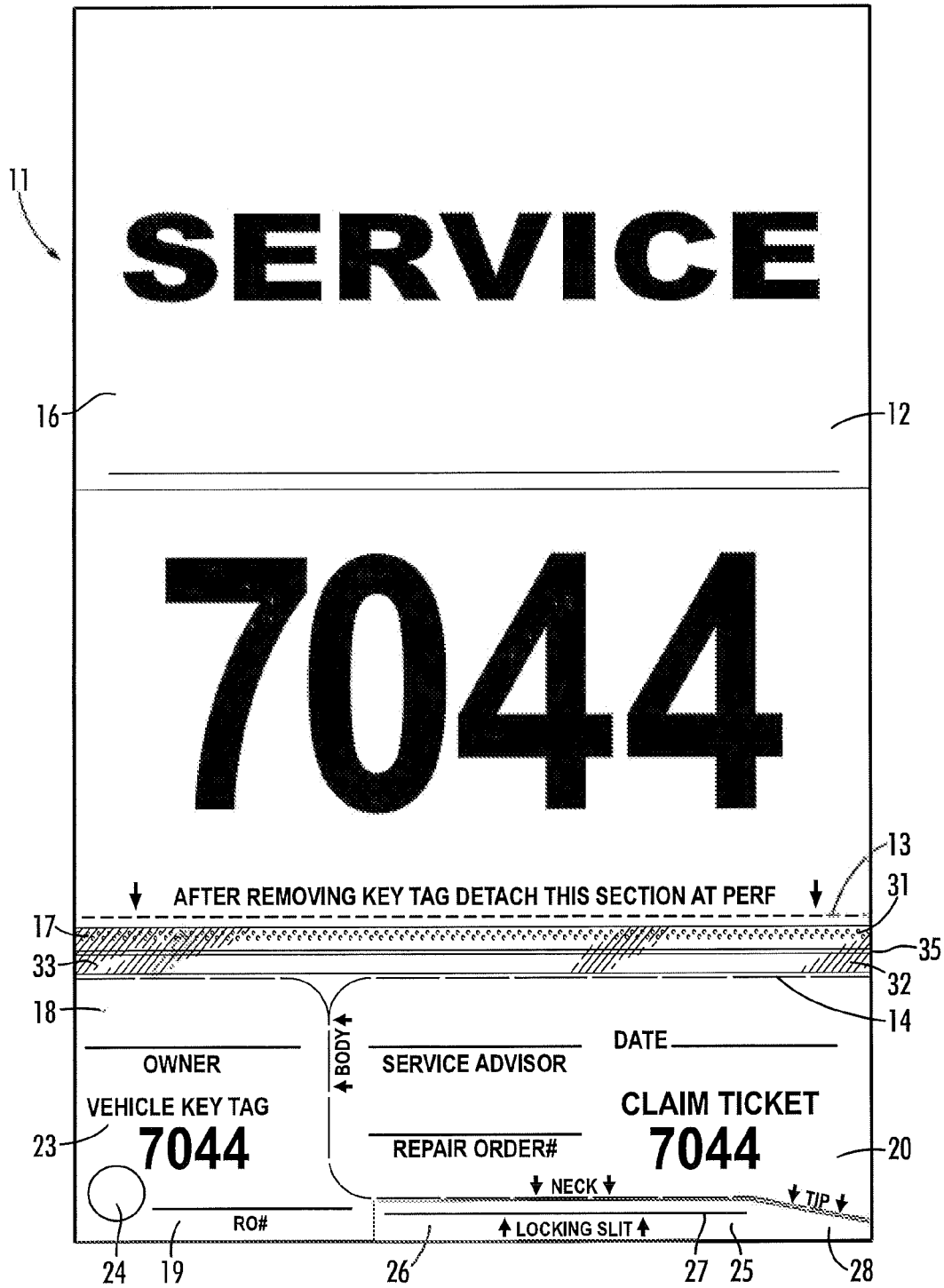
FIG. 1 shows the front side of a vehicle identification card according to an embodiment of the present invention.
Figure 3:
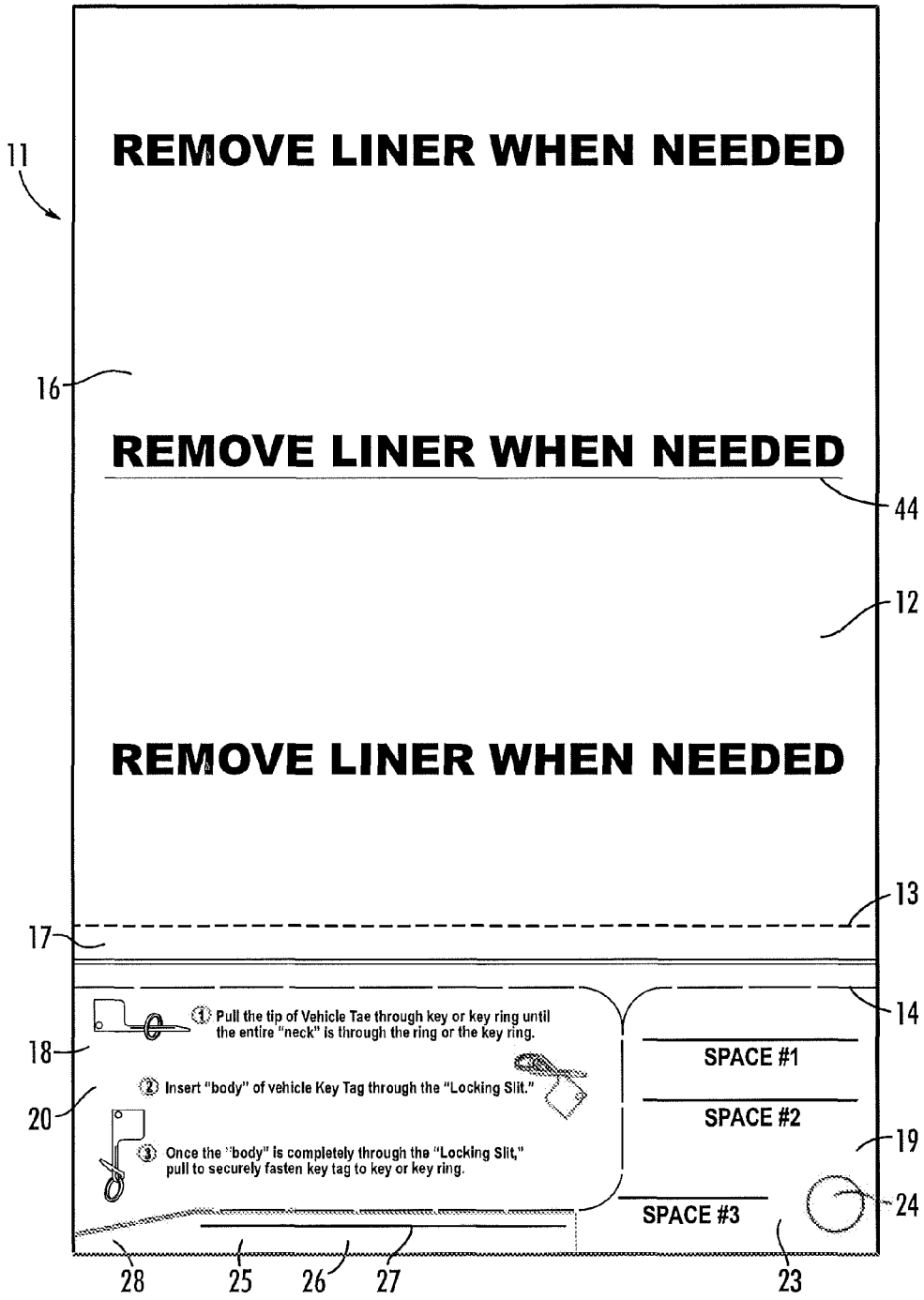
FIG. 3 shows the rear side of a vehicle identification card according to an embodiment of the present invention.

The vehicle locator card 11 shown in the drawings includes a relatively flexible sheet 12 which may be perforated along horizontal lines 13 and 14 to form an upper segment 16, an intermediate segment 17 and a lower segment 18. As shown in FIG. 1, the front side of the upper segment 16 preferably includes a vehicle identification number and a card identifier such as "SERVICE". The front side of the lower segment 18 preferably includes a vehicle key tag 19 and a customer claim ticket 20. As shown in FIG. 3, the back side of the upper segment 16 and/or lower segment 18 may include instructional material such as when to remove a certain portion, how to fold the vehicle key tag 19, and/or vehicle location identification. The sheet 12 is preferably composed of water resistant type material so that it can withstand at least mild amounts of water.

As discussed above, the respective segments may be separated by perforation lines 13 and 14. For example as shown in the drawings, the intermediate segment 17 is preferably separated from the upper segment 16 by perforation line 13. Likewise, the intermediate segment 17 is preferably separated from the lower segment 18 by perforation line 14. The vehicle key tag 19 and the customer claim ticket 20 may also be separable from the intermediate segment 17 and each other along perforation line 14.

Figure 2:
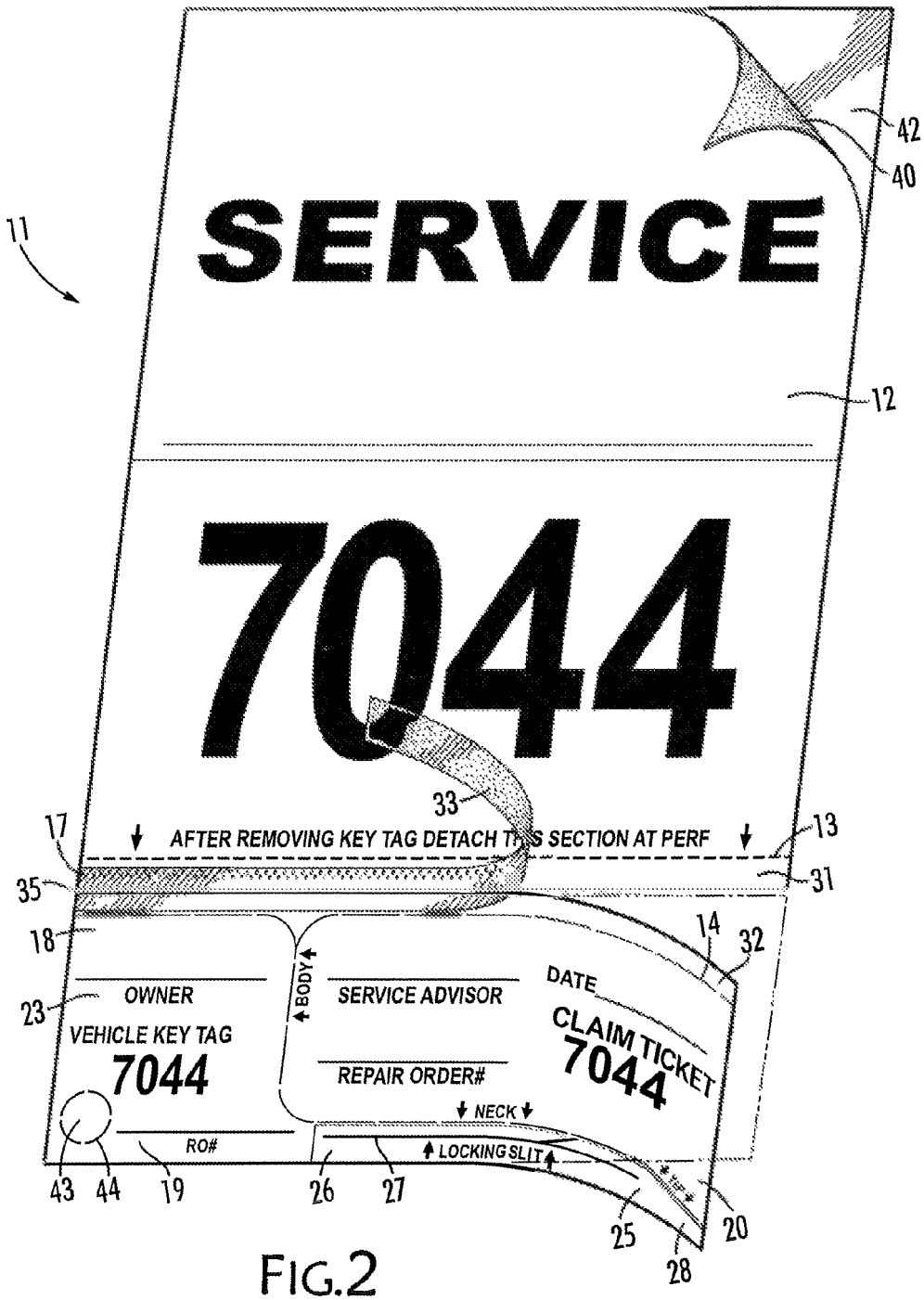
FIG. 2 shows the front side of a vehicle identification card with detachable portions peeled upward according to an embodiment of the present invention.

As shown in the embodiment of FIGS. 1 and 2, the intermediate segment includes a first portion 31 below perforation line 13 and a second portion 32 above perforation line 14. In the disclosed embodiment, first portion 31 and second portion 32 are separated from each other by an open space 35. The first portion 31 and second portion 32, however, are secured together by a securing strip 33 that is positioned over a section of first portion 31, over open space 35, and over a section of second portion 32. The securing strip 33 is preferably smooth on one side and includes an adhesive material on the opposing side to secure to first and second portions 31 and 32, respectively. In one embodiment, the securing strip is semi-transparent. In an alternative embodiment, the securing strip is transparent. The adhesive material of removing strip 33 may allow for removal and re-adhesion to first and/or second portions 31 and 32. Alternatively, a permanent adhesive may be used. The open space 35 is preferably less than a few millimeters between the first and second portions 31 and 32.

As shown in FIG. 2, an adhesive material 40 may entirely cover or partially cover the rear side of the upper segment 16. When an adhesive material is present on upper segment 16, a removable lining 42, such as a silicone coated liner, may be positioned to cover the adhesive material 40 by attaching it to the rear side of upper segment 16. If an adhesive material 40 and lining 42 are used, any written material, such as instructional or reference material, may be included on the back side of lining 42. In one embodiment, a slit 44 may be included in upper segment 16. As shown in the embodiment of FIGS. 1 through 3, the slit 44 may be positioned only on the rear side of upper segment 16 to assist with removal of the lining from the rear side of upper segment 16. The slit 44 shown in FIG. 3 extends substantially the width of upper segment 16 without extending to either side edge of upper segment 16.

Lower segment 18 may be composed of the same material as upper segment 16. Lower segment 18, however, typically does not include an adhesive material on the rear side or a lining. As discussed above, lower segment 18 may include a vehicle key tag 19 and a customer claim ticket 20. The upper segment 16, the vehicle key tag 19, and the customer claim ticket 20 preferably all include an identical vehicle identification number to assure that the vehicle, key, and customer are all related so that, for example, the appropriate vehicle and/or key is provided to the appropriate customer. As discussed above, the vehicle key tag 19 is preferably separable from the customer claim ticket 20, such as by perforation line 14. Alternatively, an additional perforation line is included to separate vehicle key tag 19 from customer claim ticket 20.

The front side of customer claim ticket 20 preferably includes reference material such as a space for insertion of a service advisor, a space for insertion of a repair order number, a space for insertion of the parking space number, and/or a space for insertion of the date. The rear side of customer claim ticket 20 also preferably includes similar type reference material or alternatively includes instructional material concerning use and insertion of a vehicle key or key ring for the vehicle key tag 19 as discussed below.

In the embodiment disclosed in FIGS. 1 through 3, the vehicle key tag 19 includes a body 23 and a tail 25. The front side of the body 23 of vehicle key tag 19 may include a space for insertion of the customer's name, a space for insertion of the vehicle's location, and, as discussed above, a vehicle identification number. The body also may include an opening 24 (shown in FIGS. 1 and 3) created after removal of insert 43 within perforation line 44 (shown in FIG. 2). The rear side of the vehicle key tag 19 preferably includes reference material such as discussed above or alternatively instructional material for insertion of a vehicle key or key ring onto the vehicle key tag 19.

The tail 25 of vehicle key tag 19 may include a neck 26, having a slit 27, and a tip 28. The slit preferably extends almost the entire length of neck 26 and the tip is preferably angled as shown in FIG. 1. When using this embodiment, the vehicle key tag 19 is removed from the remainder of the vehicle identification card 11 and a vehicle key or key ring may be positioned over tail 26. Once the vehicle key or key ring is positioned at the neck of tail 26, the body 23 may be inserted through slit 27 above the key or key ring. Once the body 23 is completely through slit 27, the tip 28 and/or body 23 may be pulled to firmly secure the key or key ring to the vehicle key tag 19 as shown in the instructional material on the rear side of vehicle identification card 11 (FIG. 3). Alternatively, opening 24 of body 23 may be used in connection with vehicle key tag 19 by removing the insert 43 within perforation line 44 to create opening 24 and inserting a key ring through opening 24.

The first portion 31 of intermediate segment 17 may be composed of the same material as upper segment 16 and therefore distinguishable only by perforation line 13. For example, if the rear side of upper segment 16 includes an adhesive material 40 and removable lining 42, the rear side of first portion 31 of intermediate segment 17 may also include an adhesive material and removable liner. Likewise, the second portion 32 may be composed of the same material as lower segment 18 and therefore distinguishable only by perforation line 14.

The outline of the key tag 19, the outline of the customer claim ticket, and the outline of the insert 43 may be formed by die cuts punched through the card lower segment 18. Perforation lines 13 and 14 may also be formed by die cuts punched through vehicle identification card 11. The die cuts may extend through both sides of the vehicle identification card 11 so that the perforations are visible on both the front and rear sides of each segment. In one embodiment, the perforations extend through the upper segment 16 including the lining 42 on the rear side of upper segment 16.

In use, such as when a vehicle is brought in for service, a vehicle identification card 11, which is typically within a stack of similar vehicle identification cards having ascending vehicle identification numbers, is selected. Attaching material may be used to removably secure multiple cards 11. Reference material, such as owner name, service advisor, date, and/or repair order number, may be written into the appropriate spaces on the front of card 11. The card is then separated using the perforations. For example, the vehicle key tag 19 may be removed via perforation line 14 and the vehicle key or key ring may be secured to the vehicle key tag 19, such as by using one of the methods discussed above. The customer claim ticket 20 may then be removed via perforation line 14 and handed to the customer. The remainder of the vehicle identification card 11 can then be secured to or positioned within the vehicle. Prior to securing or positioning the remainder of the vehicle identification card 11 within the vehicle, the intermediate segment 17 may also be removed such as via perforation 13. To secure or position the card 11 to the vehicle, the card 11 may be positioned on the dashboard of the car. Alternatively, the lining 42 may be removed as discussed above from the upper segment 16. The adhesive material 40 preferably remains on the rear side of the upper segment so that the upper segment 16 may be attached via the adhesive material 40 to a portion, such as the windshield or window, of the car. The adhesive material 40 preferably allows for easy removability so that the upper segment 16 can be removed when the vehicle is returned to the customer. Alternatively, adhesive material 40 may be included on the rear side of upper segment 16 to inform a service provider when service is necessary. For example, once the lining 42 is removed, the upper segment 16 may be folded in half and the "SERVICE" side placed upward in the dashboard of the vehicle to inform the service provider that service is still necessary on a particular vehicle. Once service is complete, the upper segment is flipped to the vehicle identification number so that the service provider is aware that service is complete and the vehicle can be easily located for pick up by the owner of the vehicle. Once the vehicle is parked or positioned in a service location, identifying location material, such as parking space number, may be written on the back of key tag 19. Thus, whenever the vehicle is needed, service personnel need only to review the back of the key tag 19 to determine the location of the vehicle.

Providing the above identifying and reference material as well as including an identical vehicle identification number on the upper segment 16, vehicle key tag 19, and customer claim ticket 20, helps servicing personnel to quickly find and retrieve the vehicle for the customer and eliminates errors and wasteful time spent trying to sort and match vehicles, keys, and customers.

It should be noted that there are several configurations suitable for the design of the vehicle identification card of the present invention, and the shapes, sizes, and dimensions of the parts of the vehicle identification card discussed above are for example only and represent but one of the configurations of the vehicle identification card. Other configurations altering the number of parts, attachment positions of the parts, means for attaching and securing the parts, and shapes, sizes, and dimensions of the parts could be employed to demonstrate the invention and are intended to be encompassed by the present invention. The description and drawings should not be deemed to narrow the scope of the present invention in any way.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. In fact, after reading the above description, it will be apparent to one skilled in the relevant art(s) how to implement the invention in alternative embodiments. Thus, the present invention should not be limited by any of the above described exemplary embodiments.

In addition, it should be understood that the figures, which highlight the functionality and advantages of the present invention, are presented for purposes of example only. The architecture of the present invention is sufficiently flexible and configurable, such that it may be used in ways other than that shown in the accompanying figures.

Further, the purpose of the Abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

What is claimed is:

1. A vehicle identification card comprising:

a multi-segmental sheet having a first segment comprising a front and back side, the back side of said first segment includes a layer of adhesive material and a removable liner covering said adhesive;

a second segment comprising a removable key tag and a vehicle identification claim ticket, said key tag having an elongated tail with a first slit extending along a longitudinal dimension of said tail and a body for inclusion of vehicle identification information; and a third segment positioned between said first segment and said second segment, said third segment comprising an upper portion and a lower portion with an opening therebetween, said upper portion and said lower portion are joined by a securing strip;

wherein said first and second segments have the same vehicle identification number thereon and wherein said second segment is separable from said third segment by perforations extending between said first and third segments.

2. The vehicle identification card of claim 1 wherein said first segment is separable from said third segment by perforations extending between said first and third segments.

3. The vehicle identification card of claim 1 wherein when said key tag is removed, said body is inserted through said slit to secure a vehicle key.

4. The vehicle identification card of claim 1 wherein said key tag further includes an opening therein.

5. The vehicle identification card of claim 4 wherein said opening is separated from said key tag by perforations.

6. The vehicle identification card of claim 1 wherein said second segment does not include adhesive material or a liner.

7. The vehicle identification card of claim 1 wherein said removable liner of said first segment further includes a second slit.

8. A vehicle identification card comprising:

a multi-segmental sheet having a first segment comprising a front and back side, the back side of said first segment includes a layer of adhesive material and a removable liner covering said adhesive;

a second segment comprising a removable key tag and a vehicle identification claim ticket, said key tag having an elongated tail with a first slit extending along a longitudinal dimension of said tail and a body for inclusion of vehicle identification information; and a third segment positioned between said first segment and said second segment, said third segment comprising an upper portion and a lower portion with an opening therebetween, said upper portion and said lower portion are joined by a securing strip;

wherein said first and second segments have the same vehicle identification number thereon;

wherein said adhesive material and said liner entirely covers said back side of said first segment.

9. The vehicle identification card of claim 8 wherein said first segment is separable from said third segment by perforations extending between said first and third segments.

10. The vehicle identification card of claim 8 wherein when said key tag is removed, said body is inserted through said slit to secure a vehicle key.

11. The vehicle identification card of claim 8 wherein said key tag further includes an opening therein.

12. A vehicle identification card comprising:

a multi-segmental sheet having a first segment comprising a front and back side, the back side of said first segment includes a layer of adhesive material and a removable liner covering said adhesive;

a second segment comprising a removable key tag and a vehicle identification claim ticket, said key tag having an elongated tail with a first slit extending along a longitudinal dimension of said tail and a body for inclusion of vehicle identification information; and a third segment positioned between said first segment and said second segment, said third segment comprising an upper portion and a lower portion with an opening therebetween, said upper portion and said lower portion are joined by a securing strip;

wherein said first and second segments have the same vehicle identification number thereon;

wherein said adhesive material and said liner extend to said upper portion of said third segment and covers the rear side of said third segment.

13. The vehicle identification card of claim 12 wherein said second segment does not include adhesive material or a liner.

14. The vehicle identification card of claim 12 wherein said removable liner of said first segment further includes a second slit.

15. A vehicle identification card comprising:

a multi-segmental sheet having a first segment comprising a front and back side, the back side of said first segment includes a layer of adhesive material and a removable liner covering said adhesive, said liner comprising a longitudinally extending first slit to assist with removal of said liner;

a second segment comprising a removable key tag and a vehicle identification claim ticket, said key tag having an elongated tail with a second slit extending along a longitudinal dimension of said tail and a body for inclusion of vehicle identification information, wherein said body includes a perforated opening, said body being insertable through said second slit; and a third segment positioned between said first segment and said second segment, said third segment comprising an upper portion and a lower portion with an opening therebetween, said upper portion and said lower portion are joined by a removable securing strip;

wherein said first and second segments have the same vehicle identification number thereon;

wherein said first segment is separable from said third segment by perforations extending between said first and third segments and said second segment is separable from said third segment by perforations extending between said second and third segments.

16. The vehicle identification card of claim 15 where said claim ticket includes instructive information for said key tag on the rear side of said claim ticket.

17. The vehicle identification card of claim 15 wherein when said key tag is removed, said body is inserted through said second slit to secure a vehicle key.

18. The vehicle identification card of claim 15 wherein said second segment does not include adhesive material or a liner.

19. The vehicle identification card of claim 15 wherein said adhesive material and said liner entirely covers said back side of said first segment.

20. The vehicle identification card of claim 15 wherein said adhesive material and said liner extend to said upper portion of said third segment and covers the rear side of said third segment.

* * * * *